US007422204B2

(12) United States Patent
Tada

(10) Patent No.: US 7,422,204 B2
(45) Date of Patent: Sep. 9, 2008

(54) WEB-PULLING SLIDER UNIT FOR AUTOMATIC WEB LEADING DEVICE

(75) Inventor: Mikio Tada, Fukuoka (JP)

(73) Assignee: Seiken Graphics Inc., Fukuoka (JP)

( * ) Notice: Subject to any disclaimer, the term of this patent is extended or adjusted under 35 U.S.C. 154(b) by 0 days.

(21) Appl. No.: 11/578,213

(22) PCT Filed: Apr. 11, 2005

(86) PCT No.: PCT/JP2005/007041

§ 371 (c)(1),
(2), (4) Date: Oct. 10, 2006

(87) PCT Pub. No.: WO2005/100023

PCT Pub. Date: Oct. 27, 2005

(65) Prior Publication Data

US 2007/0205550 A1 Sep. 6, 2007

(30) Foreign Application Priority Data

Apr. 16, 2004 (JP) ..... 2004-121900

(51) Int. Cl.
*B41F 13/06* (2006.01)
*B65H 19/00* (2006.01)
*B65H 19/10* (2006.01)

(52) U.S. Cl. ..... 270/58.07; 101/212; 101/219; 101/228; 226/92

(58) Field of Classification Search ..... 270/52.07; 101/212, 219, 228; 226/92
See application file for complete search history.

(56) References Cited

U.S. PATENT DOCUMENTS 5,029,742 A * 7/1991 Theilacker et al. ..... 226/92
5,320,039 A * 6/1994 Reponty et al. ..... 101/228

FOREIGN PATENT DOCUMENTS

| | | |
|---|---|---|
| JP | 60-141236 | 9/1985 |
| JP | 01-103647 | 7/1989 |
| JP | 05-193096 | 8/1993 |
| JP | 2004-155568 | 6/2004 |

* cited by examiner

*Primary Examiner*—Gene O. Crawford
*Assistant Examiner*—Leslie Nicholson, III
(74) *Attorney, Agent, or Firm*—Jordan and Hamburg LLP

(57) ABSTRACT

Disclosed is a web-pulling slider unit 1 for an automatic web leading device including a guide rail arranged along a web-leading path of a rotary press. The slider unit is adapted to be slidably moved along the guide rail. The slider unit comprises a closely-wound coiled spring 2, a tubular-shaped elastic member 3 formed with a connection member 7 adapted to be connected to a web, and a non-stretchable flexible center member 4 inserted through the coiled spring 2 and the elastic member 3 which are aligned adjacent to each other with a contact between respective ones of opposite ends thereof. Each of the coiled spring 2 and the elastic member 4 has the other end fixed to the center member 4. The slider unit of the present invention can stably pull and guide a web over the entire wed-leading path including a region with a complicated configuration.

11 Claims, 5 Drawing Sheets

WEB-PULLING SLIDER UNIT FOR AUTOMATIC WEB LEADING DEVICE

TECHNICAL FIELD

The present invention relates to a web-pulling slider unit for an automatic web leading device of a rotary press.

BACKGROUND ART

A rotary press is equipped with an automatic web leading device for automatically leading a web from a web feed section to a printing section and a folding section along a normal web-leading path. Presently, in rotary press manufacturers, the development of an automatic web leading device capable of coping with the entire web-leading path including a turn bar section and a bay window device has been almost completed. As such an automatic web leading device, there has been known one type designed such that a guide rail is arranged along a lateral edge of a web-leading path, and a web-pulling slider unit connected to a leading end of a web is slidingly moved along the guide rail by drive means. While drive systems for the web-pulling slider unit or branch/junction mechanisms for the guide rail in automatic web leading devices of this type are slightly different from each other, they are much alike and the difference results from structural difference in the web-pulling slider units. In other words, a major feature of the automatic web leading device in each of the rotary press manufacturers is the web-pulling slider unit itself.

For example, the following Patent Publication 1 discloses a web-pulling slider unit intended to be slidingly moved inside a guide rail with a reduced friction coefficient relative to the guide rail so as to suppress wearing. Specifically, this slider unit comprises a plurality of spherical members each made of a material having a low friction coefficient, and a plurality of joint tubes each formed of a stainless steel pipe. The spherical members and the joint tubes are alternately arranged and tied in a row using a wire inserted through center holes formed in the spherical members and the joint tubes.

In the web-pulling slider unit disclosed in the Patent Publication 1, the joint tube has opposite ends each formed in a conical concave shape allowing an adjacent one of the spherical members to be held on an axis of the joint tube. That is, the web-pulling slider unit is designed to allow only respective junctions between the spherical members and the joint tubes to be bent and twisted. Thus, while the web-pulling slider unit can be slidingly moved in conformity to a curved portion and a twisted portion in a web-leading path to a certain degree, it is difficult to fully conform to a configuration of an adjust roller section having a large winding angle and a turn bar section having complicated curve/twisting, causing a problem about difficulty in stably pulling and guiding a web.

[Patent Publication 1] Japanese Patent Laid-Open Publication No. 05-193096

DISCLOSURE OF THE INVENTION

In view of the above problem, it is an object of the present invention to provide a web-pulling slider unit for an automatic web leading device, capable of stably pulling and guiding a web over the entire wed-leading path including a region with a complicated configuration.

In order to achieve the above object, according to a first aspect of the present invention, there is provided a web-pulling slider unit (hereinafter referred to simply as "slider unit") for an automatic web leading device including a guide rail arranged along a web-leading path of a rotary press. The slider unit is adapted to be slidably moved along the guide rail. The slider unit comprises a closely-wound coiled spring adapted to be slidingly moved inside said guide rail, a connection member provided on the coiled spring and adapted to be connected to a web, and a non-stretchable flexible center member inserted through the coiled spring. The coiled spring has opposite ends each fixed to the center member.

According to a second aspect of the present invention, there is provided a slider unit for an automatic web leading device including a guide rail arranged along a web-leading path of a rotary press. The slider unit is adapted to be slidably moved along the guide rail. The slider unit comprises a closely-wound coiled spring, an elastic member provided with a connection member adapted to be connected to a web, and a non-stretchable flexible center member inserted through the coiled spring and the elastic member which are aligned adjacent to each other with a contact between respective ones of opposite ends thereof. Each of the coiled spring and the elastic member has the other end fixed to the center member.

According to a third aspect of the present invention, there is provided a slider unit for an automatic web leading device including a guide rail arranged along a web-leading path of a rotary press. The slider unit is adapted to be slidably moved along the guide rail. The slider unit comprises a closely-wound coiled spring, a connection member adapted to be connected to a web, an elastic member, and a non-stretchable flexible center member inserted through a slider body consisting of the coiled spring, the elastic member and the connection member which are aligned with each other. The slider body has opposite ends each fixed to the center member.

Preferably, in the slider unit set forth in the second or third aspect of the present invention, the coiled spring is disposed to be located at a leading end of the slider unit during the sliding movement, and the connection member is disposed to be located on a trailingmost side of the elastic member during the sliding movement. The coiled spring and the elastic member may be aligned in a total number of three or more and in an alternate arrangement. In this case, preferably, the connection member is associated with one of the one or more elastic members which is to be located closest to a trailing end of the slider unit during the sliding movement.

Preferably, in the slider unit set forth in either one of the first to third aspects of the present invention, the coiled spring is made of a metal material.

In the slider unit set forth in either one of the first to third aspect of the present invention, both the coiled spring and the center member are flexible, i.e., bendable, and the slider unit is non-stretchable as a whole. This allows the slider unit to be slidingly moved along the guide rail in a stable manner.

In the slider unit set forth in the second or third aspect of the present invention, even though the coiled spring is slightly stretched or elongated when the slider unit is slidingly moved along an adjust roller section having a small curvature radius or a turn bar section having complicated curve/twisting, the elastic member capable of absorbing the elongation and the non-stretchable center member can prevent the slider unit from being elongated and shortened as a whole so as to allow the slider unit to be slidingly moved along the guide rail in a stable manner.

As above, the slider unit of the present invention can stably pull and guide a web over the entire web-leading path including a region with a complicated configuration.

Further, the connection member adapted to be connected to a web may be disposed at a position close to the trailing end of the slider unit during the sliding movement to allow the slider unit to be slidingly moved in a stable manner so as to reliably perform a web-leading operation.

The guide rail is typically made of a metal material. Thus, the coiled spring may also be made of a metal material to provide a reduced frictional resistance and a smooth sliding movement so as to reduce a time period required for the web-leading operation.

BEST MODE FOR CARRYING OUT THE INVENTION

With reference to the drawings, an embodiment of the present invention will now be described.

First Embodiment

Figure 1:
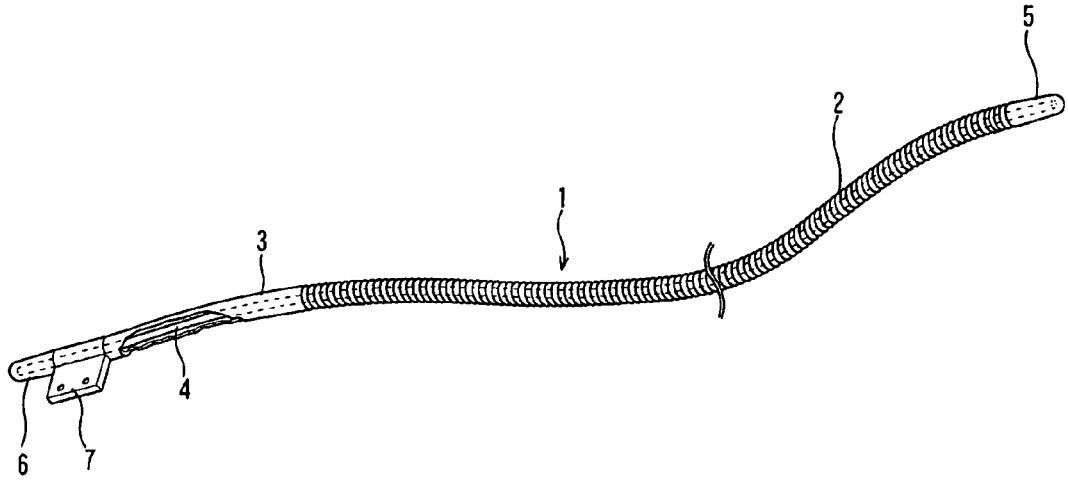
FIG. 1 is a perspective view of a slider unit according to a first embodiment of the invention.
Figure 2:
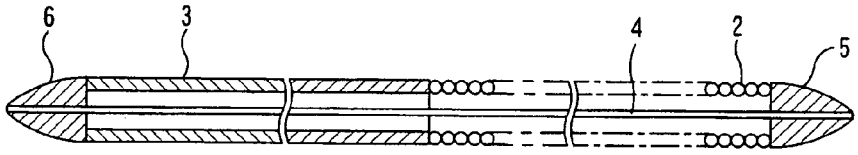
FIG. 2 is a fragmentary sectional view of the slider unit of FIG. 1.

FIG. 1 is a perspective view showing a slider unit according to a first embodiment of the present invention, and FIG. 2 is a fragmentary sectional view showing the slider unit in FIG. 1. As shown in FIGS. 1 and 2, the slider unit 1 comprises a closely-wound coiled spring 2 made of a metal material, a tubular-shaped flexible elastic member 3, and a non-stretchable flexible center member 4 inserted through the coiled spring 2 and the elastic member 3 which are aligned adjacent to each other with a contact between respective ones (first ends) of opposite ends thereof. Further, each of the coiled spring 2 and the elastic member 3 has the other end (second end) fixed to the center member 4, respectively, through a leading-side end cap 5 and a trailing-side end cap 6. Thus, the slider unit 1 can avoid the occurrence of elongation (i.e., stretching) and compression (i.e., shortening) in its entirely. In this embodiment, a tube made of a urethane resin is used as the elastic member 3, and a metal wire is used as the center member 4.

When the slider unit 1 is slidingly moved along a guide rail of an automatic web-leading device of a rotary press, as described in detail later, the end cap 5 attached to the second end of the coiled spring 2 serves as a leading end of the slider unit 1. The elastic member 3 is formed with a connection member 7 on a trailingmost side thereof. The connection member 7 is adapted to be connected to a web during the sliding movement.

Figure 3:
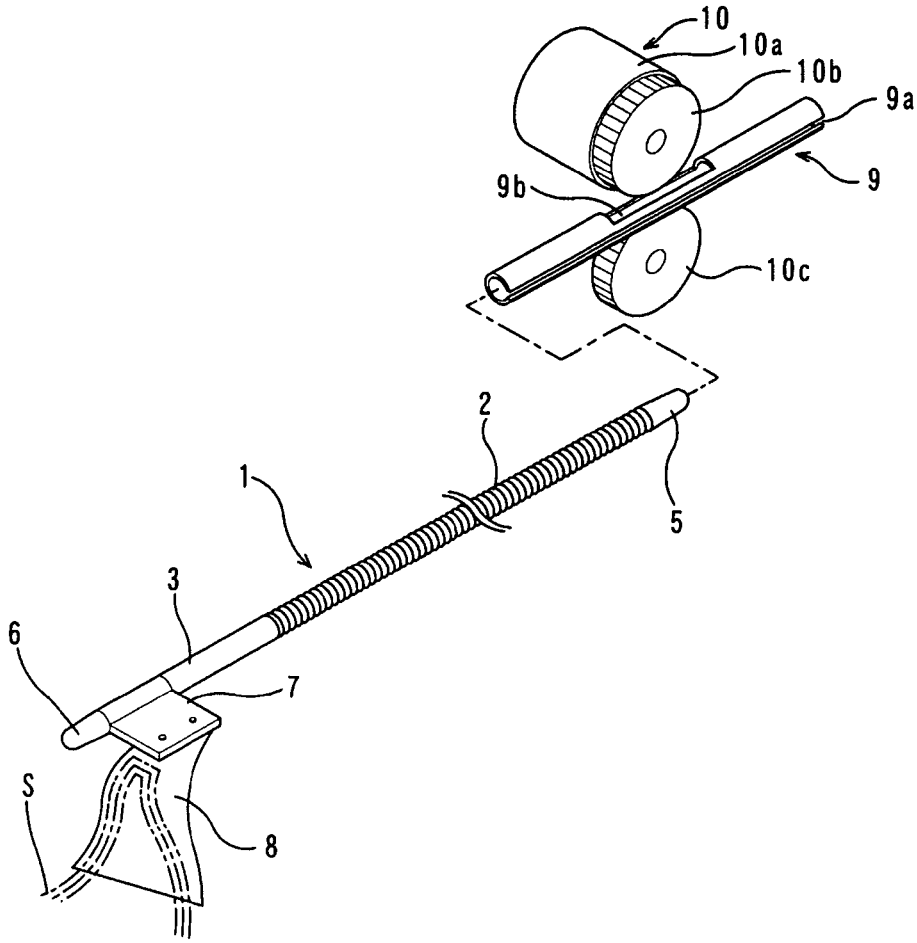
FIG. 3 is an exploded perspective view of the slider unit of FIG. 1 shown in use.

FIG. 3 is an exploded perspective view showing the slider unit in FIG. 1 during use.

As shown in FIG. 3, the connection member 7 of the slider unit 1 is connected to a web S through a tab 8, an body of the slider unit 1 except for the connection member 7 is inserted into a guide rail 9 arranged along a web-leading path of a rotary press (not shown), in such a manner as to allow the end cap 5 to be located at the leading end thereof. The guide rail 9 is formed in a pipe-like shape having an outer wall which defines a sectionally-circular internal space. The outer wall of the guide rail 9 is formed with a longitudinally-extending slit 9*a* for allowing the connection member 7 and the tab 8 to penetrate therethrough.

The slider unit 1 inserted in the guide rail 9 is adapted to be slidingly moved inside the guide rail 9 by a drive unit 10 disposed in contact with the body of the slider unit 1 through a through-hole 9*a* formed in the outer wall of the guide rail 9. Specifically, the drive unit 10 includes a drive pulley 10*b* connected to an inverter-controlled motor 10*a*, and a driven pulley 10*c*. The drive pulley 10*b* and the driven pulley 10*c* are disposed to sandwich the body of the slider unit 1 therebetween, and the inverter-controlled motor 10*a* is operable to control a speed of the sliding movement of the slider unit 1. The drive unit 10 is arranged in a plural number at given intervals allowing the slider unit 1 to be applied with a driving force at one or more positions on the web-leading path.

In the above slider unit 1, all of the coiled spring 2, the elastic body 3 and the center member 4 are flexible, i.e., bendable. Thus, the slider unit 1 is flexible as a whole. In addition, even though the coiled spring 2 is slightly stretched or elongated and the elastic member 3 is compressed or shortened due to the elongation when the slider unit 1 is slidingly moved along a complicated region, such as a region having a small curvature radius, of the web-leading path, the non-stretchable center member 4 fixed to the respective opposite ends of the slider units 1 can prevent the slider unit 1 from being elongated and shortened as a whole. Thus, the slider unit 1 can pull and guide the web S over the entire web-leading path including a region with a complicated configuration. Further, the connection member 7 adapted to be connected to the web S is disposed at a position close to the training end of the slider unit 1. This allows the slider unit 1 to be slidingly moved in a stable manner so as to reliably perform a web-leading operation.

Figure 4:
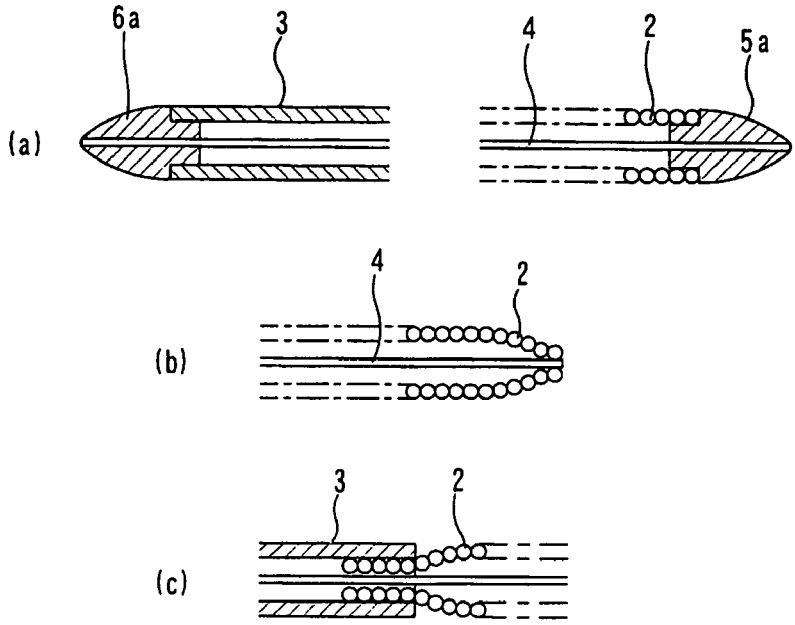
FIGS. 4*a*, 4*b* and 4*c* show various examples of modification of the slider unit according to the first embodiment.

FIGS. 4A, 4B and 4C show various examples of modification of the slider unit according to the first embodiment. In the above first embodiment, the leading-side end cap 5 and the trailing-side end cap 6 are simply in contact, respectively, with the second ends of the coiled spring 2 and the elastic member 3, as shown in FIG. 2. Alternatively, as shown in FIG. 4A, each of the end cap 5*a* and the end cap 6*a* may be formed to have a portion to be inserted into a corresponding one of respective internal spaces of the coiled spring 2 and the elastic member 3. Further, it is not essential to provide the end cap 5 and the end cap 6. For example, as shown in FIG. 4B, the second end of the coiled spring 2 may be formed in a taper shape, and a leading-side end of the center member 4 may be fixed directly to the taper-shaped end of the coiled spring 2. In a similar manner, a metal ring (not shown) may be attached around the second end of the elastic member 3 and crimped to allow the second end of the elastic member 3 to be fixed directly to a trailing-side end of the center member 4. In the above first embodiment, the respective first ends of the coiled spring 2 and the elastic member 3 are simply in contact with each other. Alternatively, as shown in FIG. 4C, the first end of the coiled spring 2 may be formed in a thinner shape, i.e., reduced in diameter, and inserted from the first end into an internal space of the elastic member 3 to allow the coiled spring 2 and the elastic member 3 to be further reliably aligned with each other.

Figure 8:
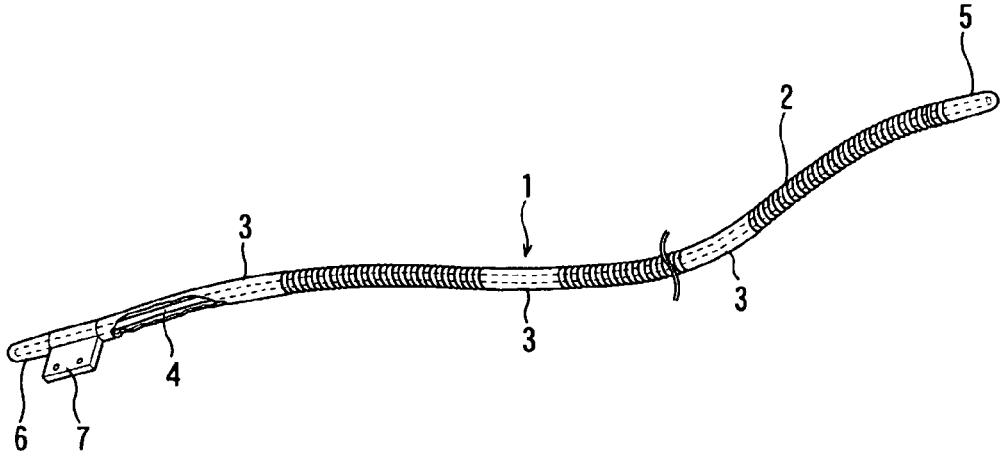
FIG. 8 is a perspective view of a slider unit according to a variation of the first embodiment wherein the elastic member and the coiled spring are provided in a total number of three or more and are alternately disposed along a length of the slider unit.

In the above first embodiment, the single coiled spring 2 and the single elastic member 3 are aligned adjacent to each other. Alternatively, as depicted, for example, in FIG. 8, the coiled spring 2 and the elastic member 3 may be aligned in a total number of three or more and in an alternate arrangement to form a slider body (consisting, for example, of two or more coiled springs 2 and two or more elastic members 3), and respective opposite ends of the slider body may be fixed to the center member 4. In this case, although not essential, the connection member 7 adapted to be connected to the web S may be formed in one of the elastic members 3 which is to be located closest to a trailing end of the slider unit 1 during the sliding movement, as shown in the depicted example of FIG.

8. It is noted that in the particular example of FIG. 8, the slider unit 1 is shown to include at least three coiled springs and at least three elastic members 3 arranged in an alternating manner along a length thereof (there being a break in the drawing within one of the coiled springs, thereby leaving the possibility that one or more additional elastic members and one or more additional coiled springs may be present in the example, although not specifically depicted).

Second Embodiment

Figure 5:
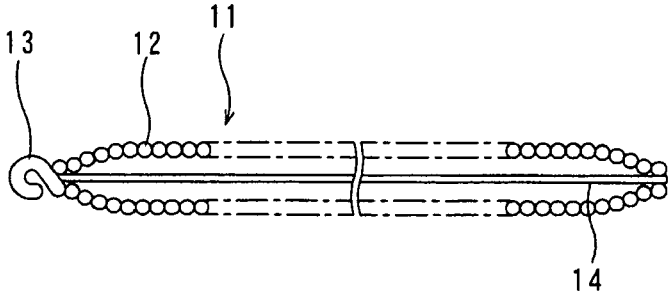
FIG. 5 is a fragmentary sectional view of a slider unit according to a second embodiment of the invention.

FIG. 5 is a fragmentary sectional view showing a slider unit according to a second embodiment of the present invention. The slider unit 11 illustrated in FIG. 5 comprises a closely-wound coiled spring 12 made of a metal material, a hook-shaped connection member attached to a trailing end of coiled spring 12, and a non-stretchable flexible center member 14 (formed of a metal wire) inserted through the coiled spring 12. The coiled spring 12 has opposite ends each fixed to the center member 14. Thus, the slider unit 11 can avoid the occurrence of elongation and compression in its entirely.

Figure 6:
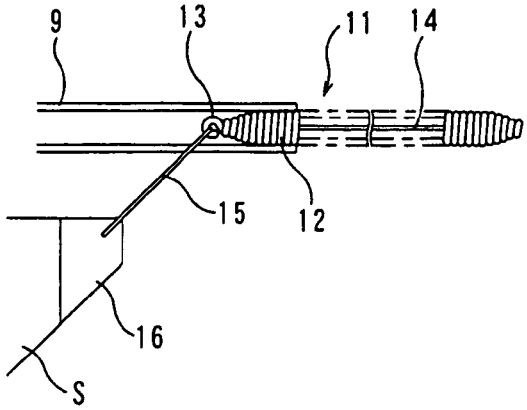
FIG. 6 is an explanatory diagram of the slider unit of FIG. 5 shown in use.

FIG. 6 is an explanatory diagram showing the slider unit in FIG. 5 during use. As shown in FIG. 6, in the second embodiment, a tab cord 15 is tied to the connection member 13. Further, a tab 16 is attached to the tab cord 15, and a leading end of a web S is adhesively attached to the tab 16. In this manner, the web S is connected to the slider unit 11. Then, the slider body 11 is inserted into the guide rail 9, and then slidingly moved by the same mechanism as that illustrated in FIG. 3 to perform the web-leading operation.

As with the slider unit according to the first embodiment, the slider unit 11 according to the second embodiment is flexible and can avoid the occurrence of elongation and compression therein. Thus, the slider unit 11 can stably pull and guide the web S. Further, the connection member 13 adapted to be connected to the web S is disposed at the training end of the slider unit 1. This allows the slider unit 1 to be slidingly moved in a stable manner so as to reliably perform the web-leading operation.

Third Embodiment

Figure 7:
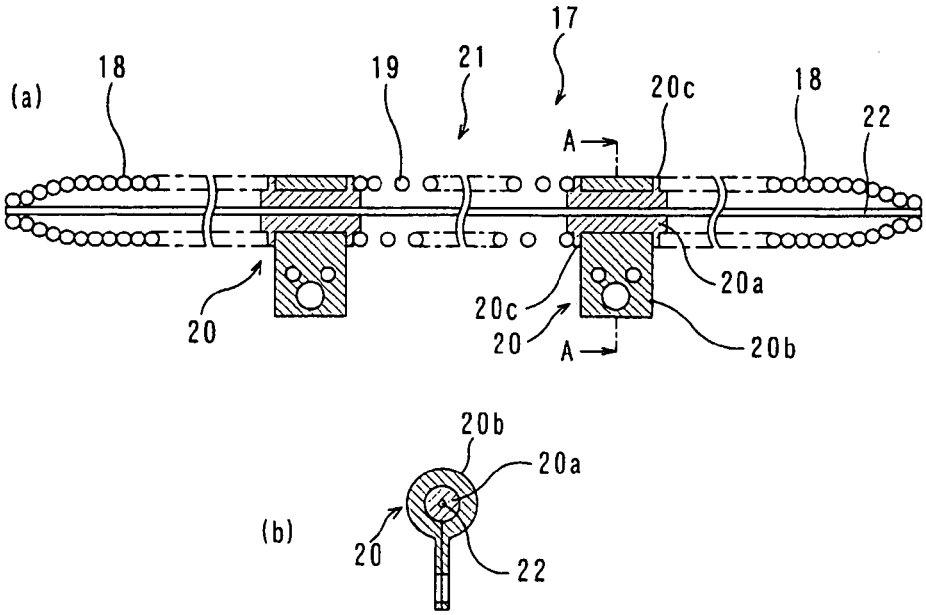
FIGS. 7*a* and 7*b* depict a slider unit according to a third embodiment of the invention.

FIGS. 7A and 7B show a slider unit according to a third embodiment of the present invention, wherein FIG. 7A is a fragmentary sectional view of the slider unit, and FIG. 7B is a sectional view taken along the line A-A in FIG. 7A. The slider unit 17 illustrated in FIGS. 7A and 7B comprises two closely-wound coiled springs 18 disposed to form, respectively, leading and trailing end thereof in a direction of a sliding movement thereof, a compression spring 19 disposed between the two coiled springs 18 to serve as an elastic member, and two connection members 20, 20 adapted to be connected to a web. Each of the connection members 20, 20 is interposed between a corresponding one of two pairs of opposed ends of the compression spring 19 and the respective coiled springs 18. The slider unit 17 further includes a non-stretchable flexible center member 22 (formed of a metal wire) inserted through a slider 21 consisting of the coiled springs 18, the compression spring 19 and the connection members 20, 20. The slider body 21 has opposite ends each fixed to the center member 22. Thus, the slider unit 11 can avoid the occurrence of elongation and compression in its entirely.

The connection member 20 comprises a connection pin 20*a*, and a connection body 20*b* mounted on an outer peripheral surface of the connection pin 20*a* and adapted to be connected to a web through a tab or a combination of a tab cord and a tab.

The connection pin 20*a* is a molded product made of a flexible material, such as a flexible plastic. The connection pin 20*a* has opposite ends each formed with a flange 20*c* extending in a radial direction at a position slightly displaced toward a longitudinal center of the connection pin 20*a*. One of the ends of the connection pin 20*a* located at a position farther from a corresponding one of the opposite ends of the slider body 21 is inserted into the compression spring 19, and the other end of the connection pin 20*a* is inserted into a corresponding one of the coiled springs 18.

The connection body 20*b* is a molded product made of a flexible material, such as a flexible plastic. The connection body 20*b* is rotatably mounted on a region of the outer peripheral surface of the connection pin 20*a* between the flanges 20*c*, 20*c*. Thus, even if the coiled spring 18 and/or the compression spring 19 are twisted when the slider unit 17 is slidingly moved along a twisted region of the guide rail, the connection body 20*b* is not twisted. Thus, the slider unit 17 can stably pull and guide the web.

In the third embodiment, when the slider unit 17 is slidingly moved along an adjust roller section having a small curvature radius or a turn bar section having complicated curve/twisting, an elongation of the coiled springs 18 is absorbed by the compression spring 19, and the slider unit 1 has no elongation/compression as a whole. Thus, the slider unit 17 can stably pull and guide the web.

In the third embodiment, the connection portion 20 is interposed between the coiled spring 18 and the compression spring 19. Alternatively, each of the coiled springs may be divided into two sub-coiled springs, and the connection portion 20 may be interposed between the sub-coiled springs. Further, while the connection member in the third embodiment is formed as a molded product made of a flexible material, such as a flexible plastic, the connection member may be made of a metal material if it has a size capable of being slidingly moved along a region of the guide rail having a small curvature radius without problems. In this case, all of the coil springs, the compression spring and the connection member may be made of a metal material to reduce a frictional resistance against a metal guide rail so as to provide a smooth sliding movement.

DESCRIPTION OF THE REFERENCE NUMERALS AND SIGNS

1, 11, 17: slider unit
2, 12, 18: coiled spring
3: tubular-shaped flexible elastic member (elastic member)
4, 14, 22: center member
5: leading-side end cap
6: trailing-side end cap
7, 13, 20: connection member
8, 16: tab
9: guide rail
10: drive unit
15: tab cord
19: compression spring (elastic member)
21: slider body
S: web

What is claimed is:

1. A web-pulling slider unit for an automatic web leading device including a guide rail arranged along a web-leading path of a rotary press, said web-pulling slider unit being adapted to be slidably moved along said guide rail, comprising:

a closely-wound coiled spring adapted to be slidingly moved inside said guide rail;

a connection member provided on said coiled spring and adapted to be connected to a web; and a non-stretchable flexible center member inserted through said coiled spring, wherein said coiled spring has opposite ends each fixed to said center member.

2. The web-pulling slider unit as defined in claim 1, wherein said coiled spring is made of a metal material.

3. A web-pulling slider unit for an automatic web leading device including a guide rail arranged along a web-leading path of a rotary press, said web-palling slider unit being adapted to be slidably moved along said guide rail, comprising:

at least one closely-wound coiled spring;

at least one elastic member provided with a connection member adapted to be connected to a web; and a non-stretchable flexible center member inserted through said at least one coiled spring and said at least one elastic member which are aligned adjacent to each other with a contact between respective ones of opposite ends thereof, wherein each of said at least one coiled spring and said at least one elastic member has an other end thereof fixed to said center member.

4. A web-pulling slider unit for an automatic web leading device including a guide rail arranged along a web-leading path of a rotary press, said web-pulling slider unit being adapted to be slidably moved along said guide rail, comprising:

at least one closely-wound coiled spring;

a connection member adapted to be connected to a web;

at least one elastic member; and a non-stretchable flexible center member inserted through a slider body comprised of said at least one coiled spring, said at least one elastic member and said connection member which are aligned with each other, wherein said slider body has opposite ends each fixed to said center member.

5. The web-pulling slider unit as defined in claim 3 or 4, wherein said at least one coiled spring is made of a metal material.

6. The web-pulling slider unit as defined in claim 3 or 4, wherein:

said at least one coiled spring is disposed to be located at a leading end of said web-pulling slider unit during the sliding movement; and said connection member is disposed to be located on a trailingmost side of said at least one elastic member during the sliding movement.

7. The web-pulling slider unit as defined in claim 6, wherein said at least one coiled spring is made of metal material.

8. The web-pulling slider unit as defined in claim 3 or 4, wherein said at least one coiled spring and said at least one elastic member are aligned in a combined total number of three or more including at least two coiled springs and at least one elastic member or at least two elastic members and at least one coiled spring alternately disposed along a length of said slider unit.

9. The web-pulling slider unit as defined in claim 8, wherein said at least one coiled spring is made of metal material.

10. The web-pulling slider unit as defined in claim 3 or 4, wherein:

said at least one coiled spring and said at least one elastic member include at least one coiled spring and at least two elastic members alternately disposed along a length of said slider unit; and said connection member is associated with one of said at least two elastic members which is to be located closest to a trailing end of the slider unit during the sliding movement.

11. The web-pulling slider unit as defined in claim 10, wherein said at least one coiled spring is made of metal material.

* * * * *